United States Patent [19]

Hamabe et al.

[11] 4,412,534

[45] Nov. 1, 1983

[54] MASSAGING APPARATUS

[75] Inventors: Takafumi Hamabe; Hiroshi Moriwaki, both of Hikone, Japan

[73] Assignee: Matsushita Electric Works, Ltd., Osaka, Japan

[21] Appl. No.: 257,003

[22] Filed: Apr. 24, 1981

[30] Foreign Application Priority Data

Jun. 6, 1980 [JP] Japan ..... 55-77003

[51] Int. Cl.[3] ..... A61H 7/00

[52] U.S. Cl. ..... 128/52; 128/57

[58] Field of Search ..... 74/764, 765; 128/56, 128/57, 44, 71–75, 52

[56] References Cited

U.S. PATENT DOCUMENTS

| | | | |
|---|---|---|---|
| 3,008,352 | 11/1961 | Peras | 74/764 |
| 3,240,083 | 3/1966 | Stoddard | 74/764 |
| 4,167,182 | 9/1979 | Yamamura | 128/56 |

OTHER PUBLICATIONS

Chironis, Mechanisms, Linkages & Mechanical Controls, p. 251, McGraw-Hill, ©1965.

*Primary Examiner*—Richard J. Apley
*Assistant Examiner*—David J. Brown
*Attorney, Agent, or Firm*—Burns, Doane, Swecker & Mathis

[57] ABSTRACT

A massaging apparatus comprises a series of massaging wheels mounted on a rotary shaft. A shifting shaft is arranged coaxially within the rotary shaft for shifting the latter in directions perpendicular to the rotary axis. A motor is coupled to both the rotary shaft and shifting shaft by means of a compact planetary type gearing which enables power to be split between the two shafts in an efficient manner so as to eliminate the need for the usual clutching mechanisms and their accompanying size and weight.

9 Claims, 12 Drawing Figures

MASSAGING APPARATUS

This invention relates generally to bed-type and chair-type massaging apparatuses for applying massages to both side muscles of the user's backbone or the like body portions by means of a pair of massaging wheels which are rolled along the backbone (which shall be referred to as "rolling massage" hereinafter) and, more particularly, to a novel multiuse massaging apparatus wherein wheels project toward the user's body and can be properly adjusted to apply the "rolling massage" of a proper light impulsion to elderly people and spinal disease patients, and yet the massaging wheels are fitted eccentrically to their supporting rotary shaft so that (i) the wheel projections can be variably increased to practice the "rolling massage" of strong impulsions and (ii) the rolling movement of the wheels can be halted at selective positions, where the wheel supporting the rotary shaft is rotated to project and retract the wheels with respect to the user's body for applying to the muscles a finger-pressure-like pressing massage (which shall be referred to as "pressing massage" hereinafter).

There has been suggested one of the massaging apparatuses of the kind referred to in, for example, the U.S. Pat. No. 4,167,182, in which case, however, eccentric massaging wheels are arranged eccentrically with respect to a rotary driving shaft so that a simpler projecting operation, that is, substantially vertically projecting and retracting motions of the wheels with respect to the shaft cannot be made and there has been embodied no idea of controlling the projection and retraction of the massaging wheels. Therefore, the simpler and thus light impulsion rolling massage and pressing massage cannot be practiced and proper massages have not been able to be applied to elderly people and spinal disease patients. Further, as a clutch mechanism has been used to control the position in the rolling movement of the wheels, the apparatus cannot be made small. There has been also a defect that, the moment the clutch mechanism is cut off the power side, the massaging operation will be made unstable by a backlash from the load side.

A primary object of the present invention is, therefore, to provide a massaging apparatus wherein the massaging wheels are connected to a power source without a clutch mechanism so as to stabilize the massage operation and to render the apparatus small and light.

Another object of the present invention is to provide a massaging apparatus wherein the projections of the massaging wheels are limited so as to realize a weak impulsion rolling massage.

A further object of the present invention is to provide a massaging apparatus wherein the massaging wheels are eccentrically fitted to a shaft so as to achieve a variable projection and retraction to also realize a strong impulsion rolling massage.

Still another object of the present invention is to provide a massaging apparatus wherein the shaft to which the massaging wheels are fitted eccentrically is prevented from being shifted but is rotated about its own axis at a fixed position so as to further practice the pressing massage.

Other objects and advantages of the present invention shall be made clear in the following disclosures of the invention detailed with reference to certain preferred embodiments shown in accompanying drawings, in which.

Figure 1:
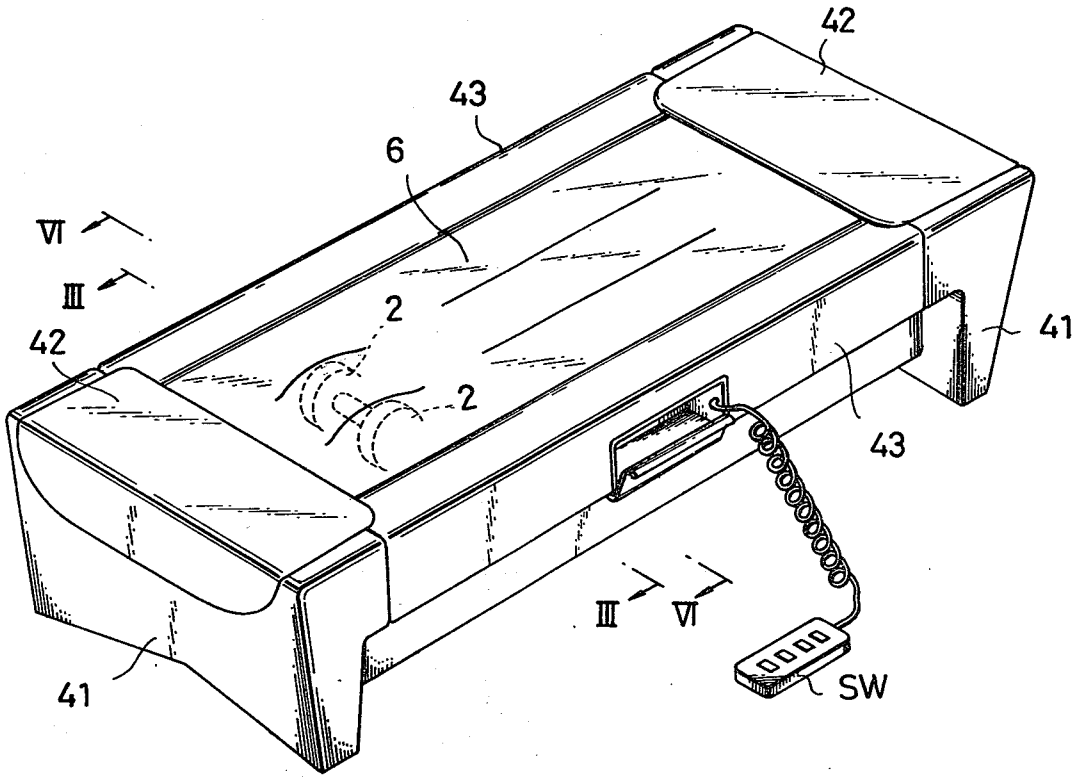
FIG. 1 is a perspective view of an embodiment in the bed-type of a massaging apparatus of the present invention.
Figure 2:
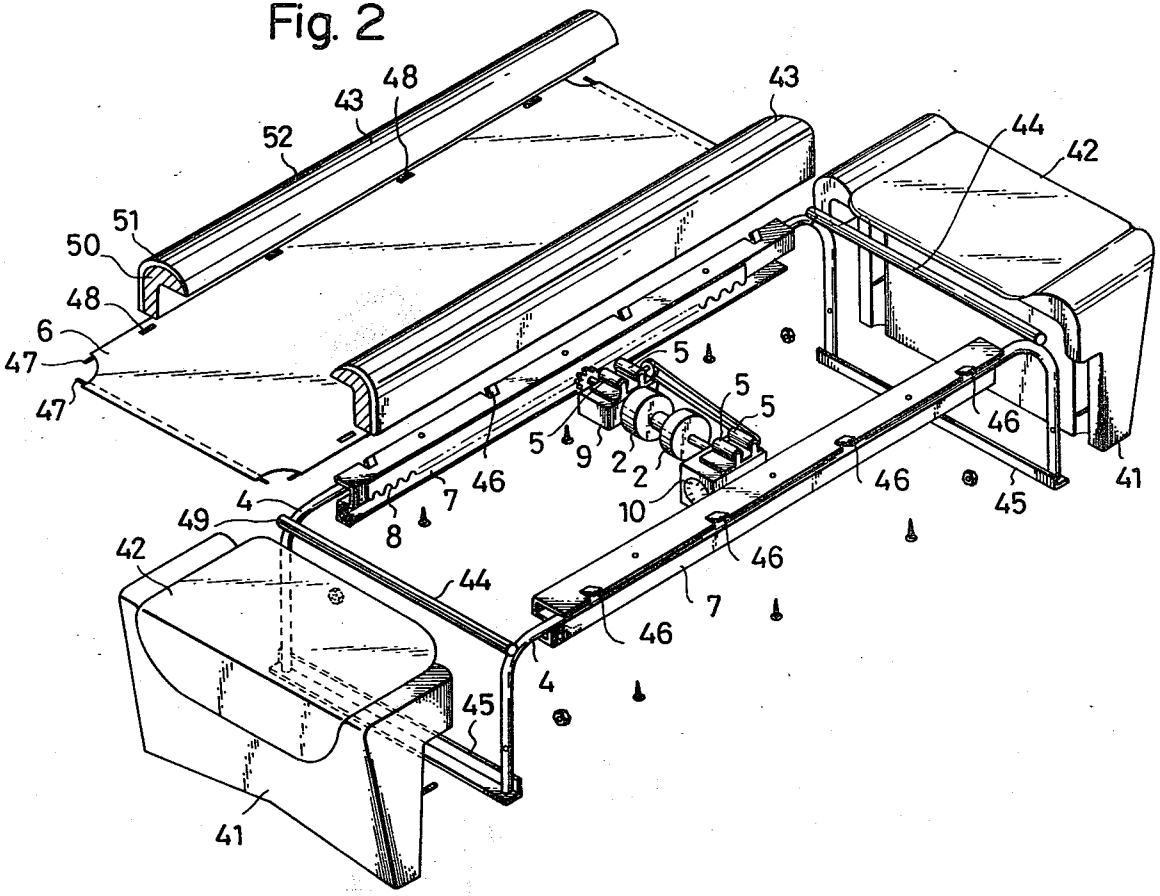
FIG. 2 is a perspective exploded view of the apparatus of FIG. 1 for showing essential parts.

While the present invention shall now be explained in the followings with reference to the preferred embodiments shown in the drawings, its intention is not to limit the invention to the particular embodiments shown but rather to include all modifications, alterations and equivalent arrangements possible within the scope of appended claims.

Figure 12:
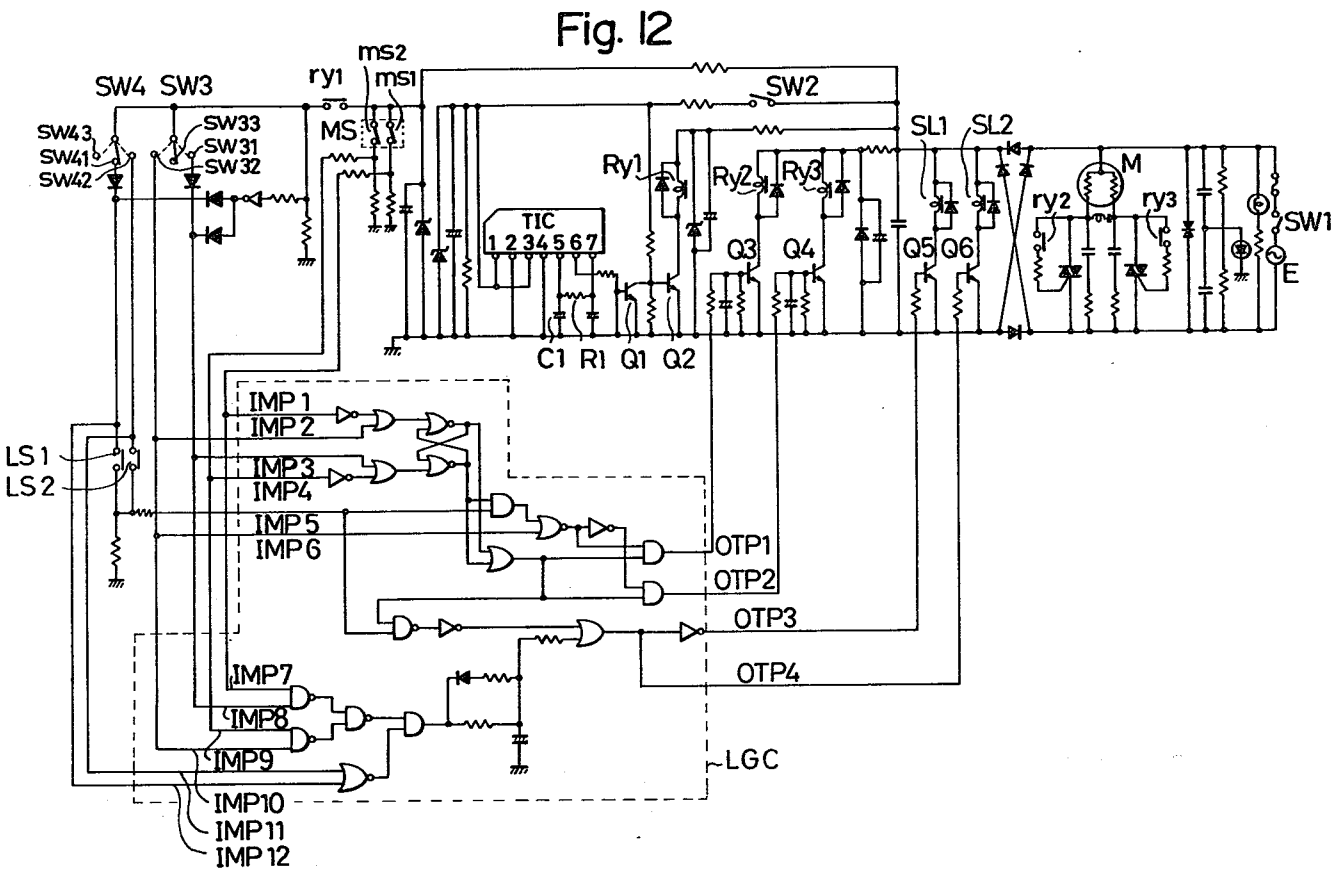
FIG. 12 is an electric circuit diagram for the apparatus shown in FIG. 1.

Referring to the embodiment of FIGS. 1 to 7 in conjunction with FIG. 12, a current source switch SW1 of a switch holder SW is made ON and a commercial current source E is connected to the massaging apparatus. When a first operating switch SW2 of the switch holder SW is made ON, an output of a fixed frequency determined by a count number of a timer element TIC and a time constant of a CR circuit of a capacitor C1 and resistance R1 is provided out of an output terminal 6 of the timer element TIC to switchover transistors Q1 and Q2 alternately ON and OFF. When the transistor Q2 is ON, a relay Ry1 is energized and a relay contact ry1 is closed.

A second operating switch, that is, a position shifting switch SW3 of the switch holder SW and a third operating switch, that is, a selecting switch SW4 for selecting the rolling massage and pressing massage as well as the strength of the rolling massages have respectively a common contact connected to the commercial current source E through the relay contact ry1 and switch SW1. The switch SW1 connects a limit switch MS to the source E, and this limit switch MS comprises a contact ms1 which is opened only when massaging wheels 2 reach one longitudinal end of rails 7 and another contact ms2 which is opened only when the wheels 2 reach the other longitudinal end, which are arranged on a gear box 10 inserted between the wheels 2 and a power source, that is, motor M.

A high level input is provided to input terminals IMP1 and IMP7 of a logical circuit LGC through the contact ms1, to input terminals IMP4 and IMP9 through the contact ms2, to input terminals IMP3 and IMP8 through the relay contact ry1 or a contact sw31 and the relay contact ry1, to input terminals IMP2, IMP6 and IMP10 through a contact 32 and the relay contact ry1, to an input terminal IMP5 through a lead switch LS1 which is closed when the projection of the massaging wheels 2 on the side of a cover sheet 6 is small, a contact sw41 and the relay contact ry1, the lead switch LS1 and relay contact ry1 or a lead switch LS2 which is closed when the projection is large, a contact sw42 and the relay contact ry1, to an input terminal IMP11 through the contact sw42 and relay ry1, and to an input terminal IMP12 through the contact sw41 and relay ry1 or the relay contact ry1. Mutually complementary signals are provided out of output terminals OTP1 and OTP2 of the logical circuit LGC in response to inputs to the input terminals IMP1 to IMP6, and other complementary signals are provided out of output terminals OTP3 and OTP4 in response to inputs to the input terminals IMP1 to IMP5 and IMP7 to IMP12. When the common contact of the switch SW3 is connected to the contact sw31 and the common contact of the switch SW4 is connected to the contact sw41, signals for rotating the motor M clockwise or counterclockwise are sent out of the output terminals OTP1 and OTP2, signals for preventing the positional shifting of the massaging wheels 2 and allowing their rotating motion until the lead switch LS1 is closed and signals for preventing the rotating motion of the wheels 2 and allowing their positional shifting after the lead switch LS1 is closed are provided out of the output terminals OTP3 and OTP4. At this time, the wheels 2 reach one longitudinal end part of the rails 7, and they stop there. When the common contact of the switch SW3 is connected to the contact sw32 and the switch SW4 is held at the contact sw41, the foregoing operations are performed except that the wheels 2 move to the other end part of the rails 7. When the common contact of the switch SW3 is connected to the contact sw33 and the switch SW4 is held at the contact sw41, the foregoing operations are performed except that the wheels 2 automatically turn at both ends of the rails 7. When the common contact of the switch SW4 is connected to the contact sw42, the projections of the wheels 2 can be made larger and the impulsion of the rolling massage can also be made higher. When the common contact of the switch SW4 is connected to the contact sw43, the signals for rotating the motor M are provided out of the output terminals OTP1 and OTP2 and the signals for preventing the positional shifting of the wheels 2 and allowing their rotating motion are provided out of the output terminals OTP3 and OTP4 irrespective of the state of the switch SW3.

In response to the signals from the output terminals OTP1 and OTP2 of the logical circuit LGC, transistors Q3 and Q4 are alternatively made ON to alternatively energize the relays Ry2 and Ry3, responsive to which energization the relay contacts ry2 and ry3 are respectively closed to rotate the motor M clockwise or counterclockwise. In response to the signals from the output terminals OTP3 and OTP4 of the logical circuit LGC, transistors Q5 and Q6 are alternatively made ON to alternatively energize solenoids SL1 and SL2, responsive to which rotations of worm shafts 11 and 13 inserted between the motor M and the massaging wheels 2 are prevented (FIGS. 4, 5, 7 and 12) and the positional shifting or rotating motion of the wheels 2 is prevented.

If the operating switch SW2 is opened at the time of either of the rolling and pressing massages, the relay Ry1 is de-energized and the relay contact ry1 is opened. Responsive to this, as will be evident from the foregoing explanations, the massaging wheels are reduced in the projections, shifted toward one longitudinal end of the rails 7 and stopped at this end part, whereby the positions of the wheels 2 after being used can be determined and it can be made safe to sit down on the massaging apparatus of the present invention even carelessly when it is not being used.

The massaging wheels 2 are arranged between respective opposing leg parts 41 of the apparatus and are eccentrically fitted to a rotary shaft 1 of a hollow cylindrical shape and arranged across the rails 7 laid along frames 4 arranged parallel to each other as coupled by lateral bars 44 and bottom plates 45 near the leg parts 41. A shifting shaft 3 is inserted through the center of the rotary shaft 1 and is pivoted at both ends to cylinders 16 each fitted with a guide roller 17 on the periphery so as to be easy to shift along the rails 7. A pinion 15 is fitted on the periphery of the respective cylinders 16 and is meshed with a rack 8 arranged on each of the rails 7. A plurality of catching projections 46 are formed on the upper surface of the respective rail 7 to enter catching holes 48 formed on each edge side of the cover sheet 6. A spindle 47 to be inserted and fitted in a slit 49 of the respective lateral bars 44 and spindles 47 to be caught and locked outside the catching projections 46 are arranged at the edge ends of the cover sheet 6. After the cover sheet 6 is fitted, a side frame 43 is fitted to the upper and side surfaces of the respective rails 7. The side frame 43 is formed by arranging in turn a foamed urethane resin 51 and cloth 52 on the outside surface of a core material 50. Then a cushion 42 is arranged on the upper surface of the respective leg parts 41.

Figure 3:
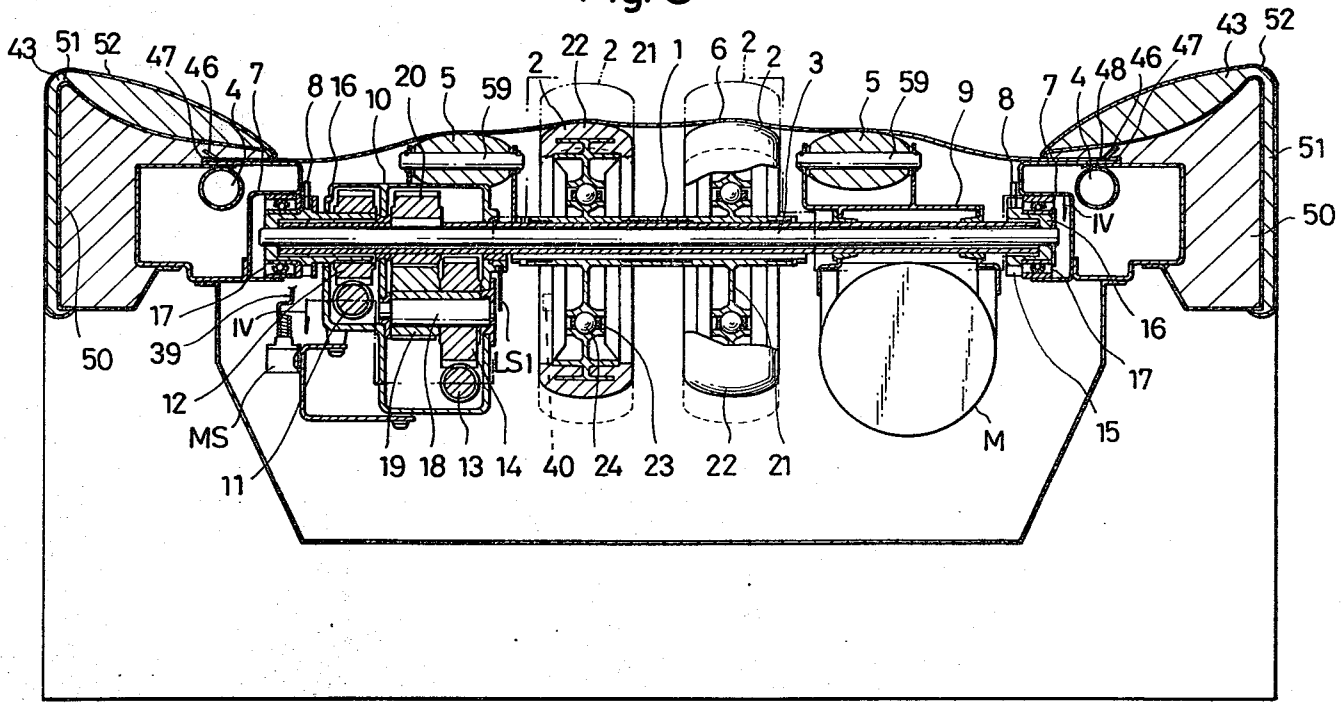
FIG. 3 is a sectioned view taken on line III—III in FIG. 1 of the apparatus shown therein.
Figure 4:
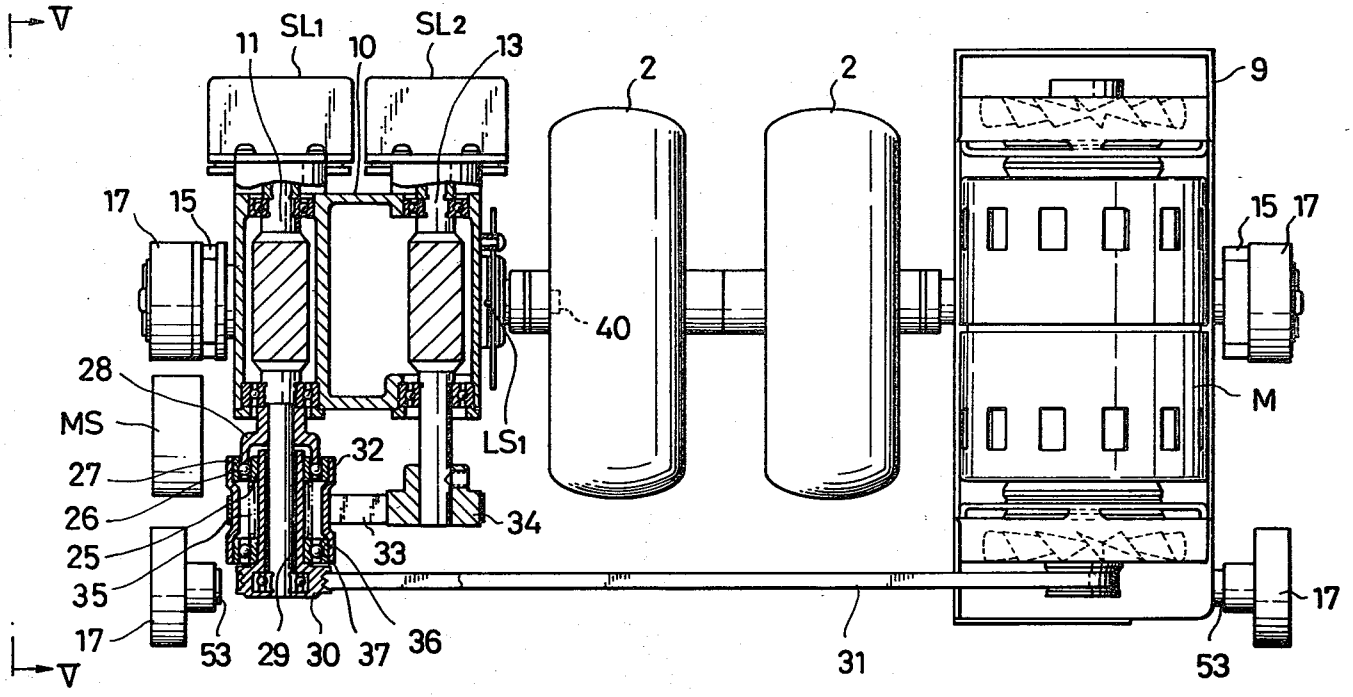
FIG. 4 is a fragmentary plan view as seen on line IV—IV in FIG. 3 for showing essential parts of the apparatus of FIG. 1 and as partly sectioned specifically at a planetary gear mechanism used therein.
Figure 5:
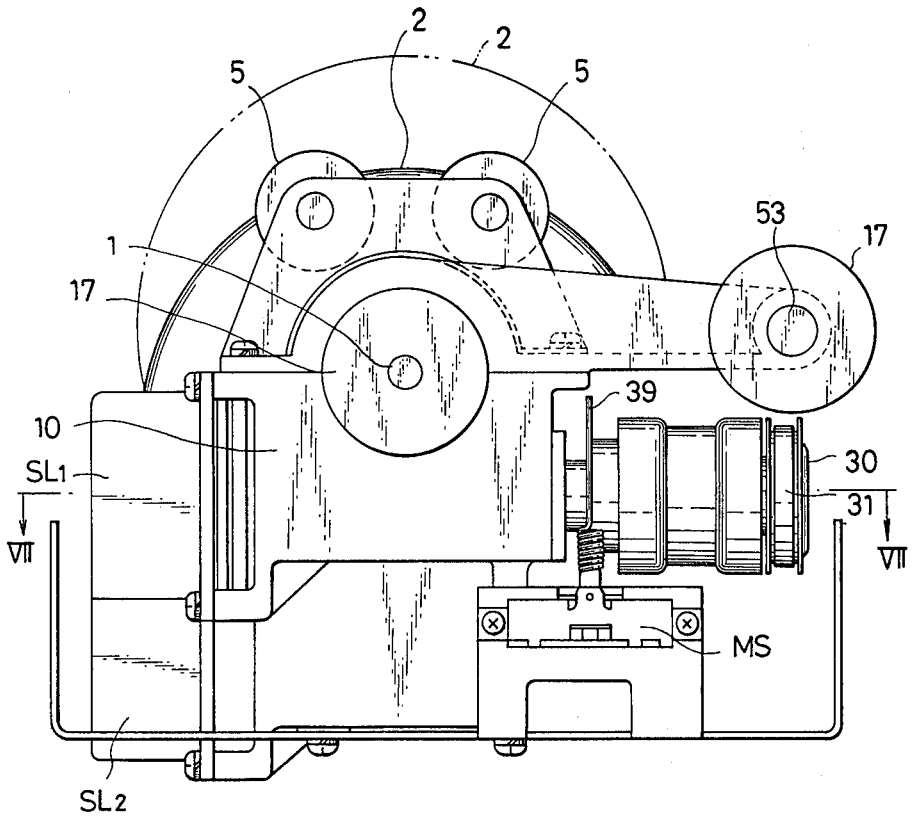
FIG. 5 is a side view of the essential parts of FIG. 4 as seen on line V—V therein.
Figure 7:
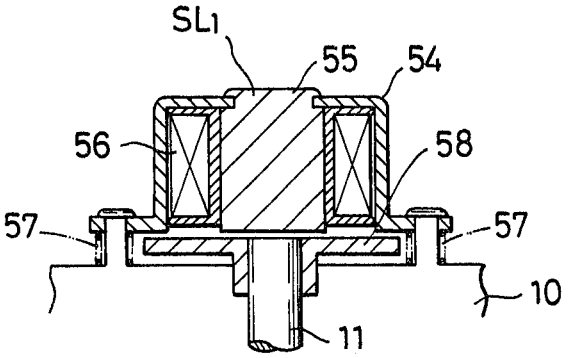
FIG. 7 is a fragmentary sectioned view of the planetary gear mechanism of FIG. 4 taken on line VII—VII in FIG. 5.
Figure 8:
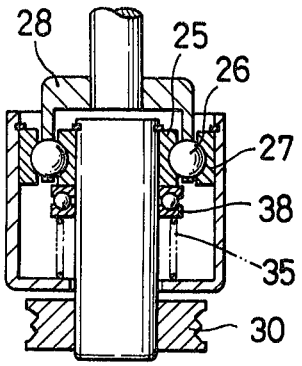
FIG. 8 shows another embodiment in section of the planetary mechanism of FIG. 4.
Figure 9:
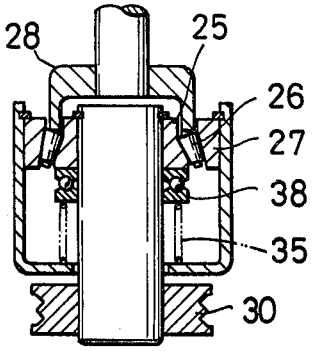
FIG. 9 shows in a sectioned view of still another embodiment of the planetary mechanism.
Figure 10:
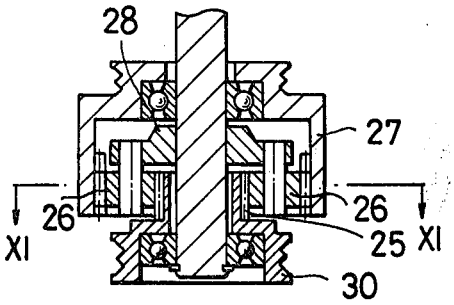
FIG. 10 shows in a sectioned view taken on line X—X in FIG. 11 of a further embodiment of the planetary mechanism.
Figure 11:
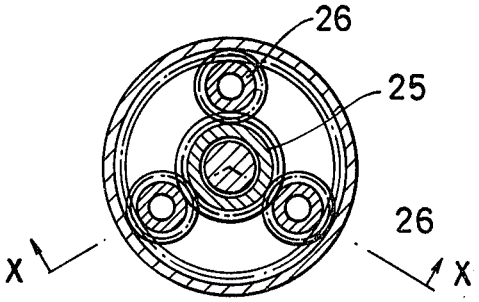
FIG. 11 is a sectioned view taken on line XI—XI in FIG. 10 of the mechanism in FIG. 10.

The rotary shaft 1 is, as seen in FIG. 3, supported at both ends on the inner peripheral surface of the guide rollers 17 to be rotatable about the axis of the shaft and has eccentric shaft parts 21 of the wheels 2 secured in the middle. An outer wheel member 22 is arranged through steel balls 24 arranged within a retainer 23 in each eccentric shaft part 21. Each of the massaging wheels 2 is in contact on the upper surface with the cover sheet 6. Upon rotation of the rotary shaft 1, the eccentric shaft parts 21 rotate together to move the outer wheels 22 up and down with respect to the rotary shaft 1 and shifting shaft 3 and move the cover sheet 6 up and down so that the pressing massage can be practiced. A motor block 9 is fitted near the right end (in FIGS. 3 and 4) of the rotary shaft 1. A motor M is suspended on the lower surface of the motor block 9. Side rollers 5 rotatably held by rotatable shafts 59 are arranged on the upper surface of the block 9, and a difference in the height between the upper surface of the side rollers 5 and that of the massaging wheels 2, that is, the difference between the distances from the rotary shaft 1 or shifting shaft 3 to the respective upper surfaces of the rollers and wheels is set to be less than about 5 mm. Other guide rollers 17 are fitted to the motor block 9 through rotatable shafts 53 and are movably arranged on the rails 7 (FIG. 4). A gear box 10 is fitted near the left end in FIGS. 3 and 4 of the rotary shaft 1 and is connected to the output shaft of the motor M by means of a belt 31. A pulley 30 on which the belt 31 is hung is rotatably fitted to one end of the worm output shaft 11, and is extended along the worm shaft 11 by means of an integral rotatable collar 29. A first inner race 25 and a second inner race separated from the first inner race 25 by a precompressed spring 35 are secured on the peripheral surface of the collar 29 and function in the manner of a sun gear. That is, an outer race 27 is arranged on the inner race 25 via planetary gears defined by balls 17 disposed on the peripheral surface of the inner race 25. Balls 37 and outer race 36 are arranged on the peripheral surface of the above referred second inner race. A ring or pulley 32 is secured on the peripheral surfaces of the respective outer races 27 and 36. A planetary carrier, that is, retainer 28 rotatably holding the balls 26 is secured to the worm shaft 11 rotatably supported in the gear box 10 and having a solenoid SL1 arranged at the other end (FIGS. 4, 5 and 7). The solenoid SL1 is provided with a coil 56 wound on the periphery of a core 55 and with a yoke 54 arranged on the peripheral surface of the coil 56 as secured to the core 55 and fitted resiliently to the gear box 10 through expanded springs 57 so that the solenoid assembly will be resiliently attracted, when the coil 56 is energized, to a rotary block 58 secured to the other end of the worm shaft 11 (FIG. 7) to restrict its rotation. A pulley 34 is arranged at one end of the worm output shaft 13 and is connected to the pulley 32 by means of a belt 33. In the case when the rotation of the worm shaft 11 is thus prevented by the energization of the solenoid SL1, the rotation of the retainer 28 is also prevented but the pulley 32 is caused to rotate to transmit the torque to the other worm shaft 13 through the belt 33. The worm shaft 13 is also fitted through bearings in the gear box 10 in the same manner as the worm shaft 11 and has the solenoid SL2 similar to the solenoid SL1 and disposed at the other end of the shaft 13.

Further, the rotatable shaft 53 is held in the gear box 10. The other guide roller 17 arranged on the rail 7 is fitted to the rotatable shaft 53 (FIGS. 4 and 5). On the upper surface of the gear box 10, other side rollers 5 are also arranged as born by rotatable shafts 59 in the same manner as those on the upper surface of the motor block 9. A limit switch MS is arranged on the outside surface of the gear box 10 and will function as described before when an actuator 39 is reached near the leg parts 41. On the other hand, limit switches LS1 and LS2 are arranged on the inside surface of the gear box 10 and are operated to open and close as detailed above by a permanent magnet 40 arranged on the side surface of the wheels 2 (the limit switch LS2 is not illustrated).

The worm shaft 11 meshes with a worm wheel 12 secured to the cylinder 16 and shifts the position of the driving shaft 3 along the racks 8 and rails 7 with the pinions 15 formed on the cylinders 16. The worm shaft 13 meshes with a worm wheel 14 secured to a rotatable shaft 18 pivoted to the gear box 10. An elliptic gear 19 is secured to the shaft 18, and another elliptic gear 20 secured to the rotary shaft 1 is in mesh with the elliptic gears 19. With these elliptic gear 19 and 20, the rotating velocity of the massaging wheels 2 on the shaft 1 can be properly adjusted during each cycle and the force of the "pressing massage" can be made proper.

Figure 6:
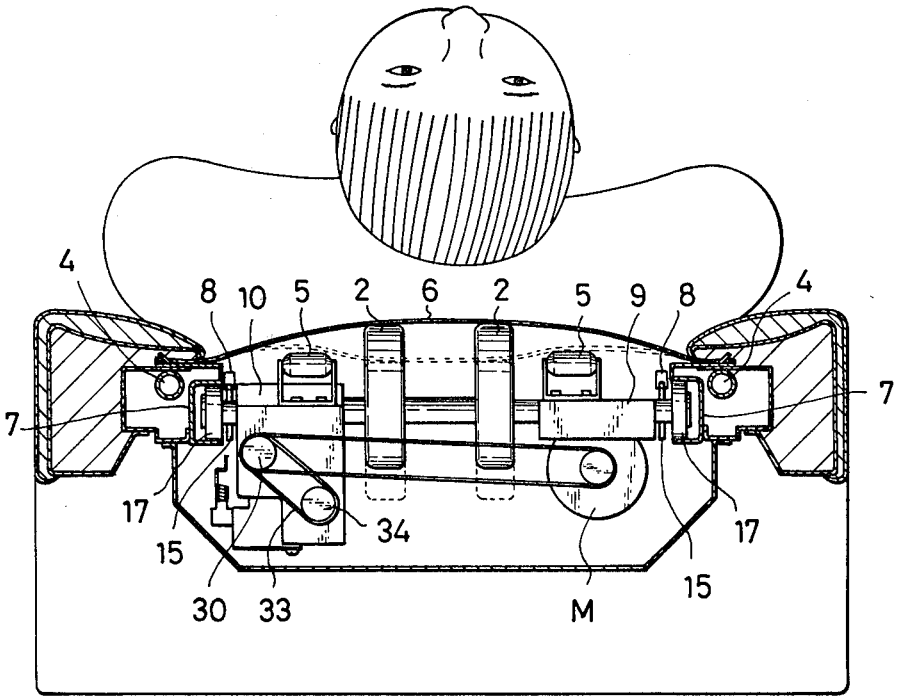
FIG. 6 is a sectioned view of the apparatus in use of FIG. 1 taken on line VI—VI therein.

As will be evident from the foregoing descriptions, the shifting shaft 3 in the rotary shaft 1 is selectively driven by means of the solenoids SL1 and SL2, so that the projections of the massaging wheels 2 with respect to the side rollers 5 can be properly adjusted so as to practice the "rolling message" and "pressing massage," as shown with broken lines and solid lines in FIGS. 3, 5 and 6.

The planetary gear mechanism in the gear box 10 may be of such arrangements as shown in FIGS. 8 to 11, wherein the arrangements are substantially identical to the one set forth already except that a thrust bearing 38 is disposed between the precompressed spring 35 and the inner race 25, while other parts are denoted by corresponding reference numerals for easy understanding.

It will be also clear that, when other limit switches than the limit switches LS1 and LS2 but similar thereto are arranged, the massaging wheels 2 will be able to be stopped at proper rotating positions so as to adjust the projections and to thereby attain proper massaging impulsions.

While the standard of the projection of the massaging wheels 2 is determined by the side rollers in the foregoing descriptions, it will be also apparent that the projection may be determined by any other means.

While the rotary shaft 1 and shifting shaft 3 are alternatively driven by the output of the gear box 10 but they may be properly varied in the driving rate by properly varying the solenoids SL1 and SL2 and others as required.

What is claimed is:

1. A massaging apparatus comprising a motor, a rotary shaft rotated by said motor, massaging wheels attached to said rotary shaft, and a shifting shaft arranged coaxially within said rotary shaft for shifting the rotary shaft in directions perpendicular to the axial direction of the rotary shaft by means of the output of the motor, wherein said motor is connectible to said rotary shaft and shifting shaft through a gearing including a planetary mechanism, and said gearing comprising an input shaft driven by said motor and secured to a sun part of said planetary mechanism, a first output shaft connected between a planetary carrier of said planetary mechanism and one of the rotary shaft and shifting shaft, and a second output shaft connected between a rotary ring of the planetary mechanism and the other one of the shifting shaft and rotary shaft.

2. A massaging apparatus according to claim 1 wherein a braking means for selectively braking said first and second output shafts is provided.

3. A massaging apparatus according to claim 1 wherein said massaging wheels are eccentrically fitted to said rotary shaft.

4. A massaging apparatus according to claim 3 wherein said massaging wheels and rotary shaft carrying the wheels can be held stationary at any desired positions in their rotation.

5. A massaging apparatus according to claim 3 wherein said shifting of said rotary shaft by means of said shifting shaft is reciprocated within a predetermined range between two optional positions.

6. A massaging apparatus according to claim 1, including means for preventing rotation of either of said first and second output shafts while permitting the other of said output shafts to rotate.

7. A massaging apparatus comprising a motor, a rotary shaft axially rotated by the output of said motor, massaging wheels fitted to said rotary shaft and a shifting shaft for shifting the rotary shaft in directions perpendicular to the axial direction of the rotary shaft with the output of the motor, wherein said motor is connected to said rotary shaft and shifting shaft through a gearing including a planetary mechanism, said gearing comprises an input shaft receiving the input of said motor and secured to a sun part in the form of an inner race of said planetary mechanism, a first output shaft connected between a planetary carrier of said planetary mechanism and either one of the rotary shaft and shifting shaft and a second output shaft connected between a rotary ring in the form of an outer race of the planetary mechanism and the remainder of the shifting shaft and rotary shaft, a plurality of antifriction members are arranged between said inner and outer races, said planetary carrier is formed of a retainer for regulating the operation of said antifriction members, and precompressed springs bias either one of said inner and outer races in a thrusting direction.

8. A massaging apparatus comprising a motor, a rotary shaft axially rotated by the output of said motor, massaging wheels fitted eccentrically to said rotary shaft and a shifting shaft for shifting the rotary shaft reciprocally within a predetermined range in directions perpendicular to the axial direction of the rotary shaft with the output of the motor, wherein said motor is connected to said rotary shaft and shifting shaft through a gearing including a planetary mechanism, said gearing comprises an input shaft receiving the input of said motor and secured to a sun part of said planetary mechanism, a first output shaft connected between a planetary carrier of said planetary mechanism and either one of the rotary shaft and shifting shaft and a second output shaft connected between a rotary ring of the planetary mechanism and the remainder of the shifting shaft and rotary shaft, said shifting of said rotary shaft by means of said shifting shaft is stopped at the end of said predetermined range, and said axial rotation of the rotary shaft is stopped at a position where the projection of said massaging wheels is minimized.

9. A massaging apparatus comprising a motor, a rotary shaft axially rotated by the output of said motor, massaging wheels fitted eccentrically to said rotary shaft, side rollers arranged on both sides of said massaging wheels for properly adjusting the projection of the massaging wheels, and a shifting shaft for shifting the rotary shaft reciprocally within a predetermined range in directions perpendicular to the axial direction of the rotary shaft with the output of the motor, wherein said motor is connected to said rotary shaft and shifting shaft through a gearing including a planetary mechanism, said gearing comprises an input shaft receiving the input of said motor and secured to a sun part of said planetary mechanism, a first output shaft connected between a planetary carrier of said planetary mechanism and either one of the rotary shaft and shifting shaft and a second output shaft connected between a rotary ring of the planetary mechanism and the remainder of the shifting shaft and rotary shaft, said shifting of said rotary shaft by means of said shifting shaft is stopped at the end of said predetermined range, and said axial rotation of the rotary shaft is stopped at a position where the projection of said massaging wheels is minimized.

* * * * *